US007046207B2

(12) United States Patent
Takahashi

(10) Patent No.: US 7,046,207 B2
(45) Date of Patent: May 16, 2006

(54) ANTENNA MOUNTING STRUCTURE

(75) Inventor: Motonao Takahashi, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 10/902,178

(22) Filed: Jul. 30, 2004

(65) Prior Publication Data

US 2005/0024280 A1 Feb. 3, 2005

(30) Foreign Application Priority Data

Jul. 31, 2003 (JP) ..... P2003-204782

(51) Int. Cl.
*H01Q 1/32* (2006.01)

(52) U.S. Cl. ..... 343/711; 343/713; 343/872

(58) Field of Classification Search ..... 343/711, 343/713
See application file for complete search history.

(56) References Cited

U.S. PATENT DOCUMENTS

| | | | | |
|---|---|---|---|---|
| 2,392,491 | A | 1/1946 | Moran | |
| 6,879,301 | B1 * | 4/2005 | Kozlovski | 343/878 |
| 2003/0231140 | A1 | 12/2003 | Haussler et al. | |

FOREIGN PATENT DOCUMENTS

| | | | |
|---|---|---|---|
| DE | 20 2004 007 160 U1 | | 7/2004 |
| JP | B2-2751146 | | 2/1998 |
| JP | 2005-45581 | * | 2/2005 |
| WO | WO 2005/051720 A1 | * | 6/2005 |

* cited by examiner

*Primary Examiner*—Trinh Dinh
(74) *Attorney, Agent, or Firm*—Morgan, Lewis & Bockius LLP

(57) ABSTRACT

A structure for mounting an antenna device on a first side of a panel body is disclosed. A first fixation member includes a first end having a first width, a second end, and a slit connecting the first end and the second end. A protrusion is protruded from the antenna device and fitted into the first end of the first fixation member. A second fixation member is fitted into the second end of the first fixation member while being coupled with the protrusion in a screwing manner. The first width is smaller than a third width of an aperture formed in the panel body when the protrusion and the second fixation member are in a first screwing position, so that the protrusion, the first fixation member and the second fixation member are allowed to pass through the aperture from the first side to a second side. The slit is expanded such that the first end of the first fixation member is made to have a fourth width which is greater than the third width when the protrusion and the second fixation member are in a second screwing position where the protrusion and the second fixation member are closed to each other than the first screwing position.

4 Claims, 10 Drawing Sheets

FIG. 10A
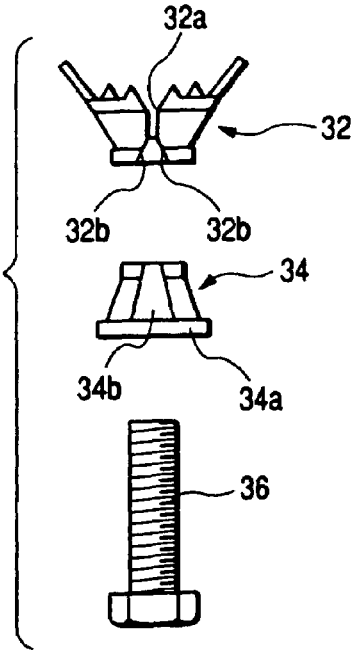
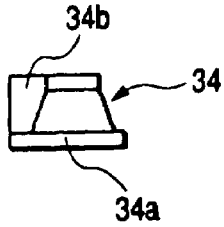
FIG. 10B
FIG. 11
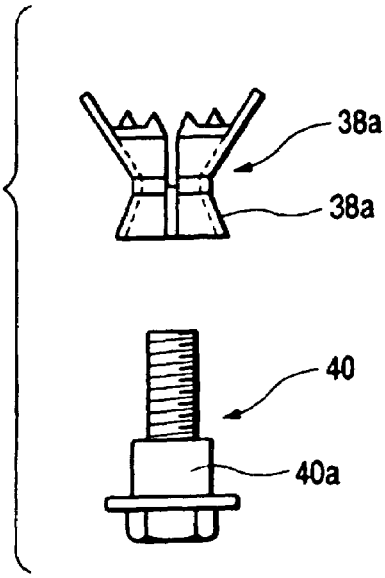

ANTENNA MOUNTING STRUCTURE

BACKGROUND OF THE INVENTION

The present invention relates to an antenna attaching apparatus for attaching an antenna base to the roof of a vehicle body.

In the structure of a conventional antenna attaching apparatus for attaching an antenna device for a vehicle to the roof of a vehicle body, a mount screw protruded downward from the antenna base of the antenna device for a vehicle is inserted through a mount hole formed on the roof and a washer having a claw is fitted and inserted from below into the mount screw protruded downward from the roof, and furthermore, a nut is screwed and fixed. In order to enhance a workability, the washer having a claw and the nut are coupled and integrated so as to be relatively rotatable around a screw axis and not to be separated from each other in the direction of the screw axis. In order to enhance the workability, furthermore, Japanese Patent No. 2751146 has proposed a technique for provisionally fixing a nut to a mount screw through a washer having a claw. According to the proposed technique, the nut can be prevented from slipping from the mount screw even if an operator releases his or her hand from the nut after the provisional fixation. Consequently, the workability can be improved.

In this structure, the nut can be prevented from slipping off even if an operator releases his or her hand from the nut after the nut is provisionally fixed to the mount screw, thereby improving the workability. However, it is necessary to carry out a working step of provisionally fixing the nut, from below a roof panel, to the mount screw inserted through the mount hole from above the roof panel.

SUMMARY OF THE INVENTION

It is therefore an object of the invention to provide an antenna mounting structure capable of provisionally fixing an antenna base by an insertion through a mount hole of a roof panel from above, thereby further improving the workability.

In order to achieve the above object, according to the invention, there is provided a structure for mounting an antenna device on a first side of a panel body, comprising:

a first fixation member, comprising:

a tubular body, including a first end having a first width, a second end, and a slit connecting the first end and the second end; and a plurality of elastic claw members, including a pair of claw members extended from the first end of the tubular body such that an interval between distal ends thereof is a second width which is larger than a third width of an aperture formed in the panel body;

a protrusion, protruded from the antenna device and fitted into the first end of the first fixation member;

a second fixation member, fitted into the second end of the first fixation member while being coupled with the protrusion in a screwing manner, wherein:

the first width is smaller than the third width when the protrusion and the second fixation member are in a first screwing position, so that the protrusion, the first fixation member and the second fixation member are allowed to pass through the aperture from the first side to a second side while flexing the pair of claw members inward;

the pair of claw members restore so as to prevent the protrusion, the first fixation member and the second fixation member from passing through the aperture from the second side to the first side; and the slit is expanded such that the first end of the first fixation member is made to have a fourth width which is greater than the third width when the protrusion and the second fixation member are in a second screwing position where the protrusion and the second fixation member are closed to each other than the first screwing position.

With this configuration, a provisional fixation state can be established by merely passing the protrusion, the first fixation member and the second fixation member which are coupled to each other through the aperture from the first side to the second side. The antenna device can be surely fixed on the panel body by screwing the second fixation member and the protrusion from this provisional fixation state. Since the operation for provisionally fixing the members on the panel body is simple and easy, it is suitable for mass production.

Preferably, a wedge member is formed on at least one of the protrusion and the second fixation member, the wedge member fitted into the slit when the protrusion and the second fixation member are in the first screwing position. The wedge member is configured so as to expand the slit when the protrusion and the second fixation member are in the second screwing position.

With this structure, not only the slit is reliably expanded, but also the first fixation member is prevented from being rotated in accordance with the screwing action of the second fixation member.

Preferably, the first end of the second fixation member has a first diameter and the second end of the second fixation member has a second diameter which is larger than the first diameter.

With this structure, the slit is automatically expanded in accordance with the screwing action of the second fixation member.

Preferably, the aperture and the protrusion are shaped into rectangular.

With this structure, the protrusion is prevented from being rotated in accordance with the screwing action of the second fixation member. Therefore, the posture of the antenna device can be properly maintained.

BRIEF DESCRIPTION OF THE DRAWINGS

The above objects and advantages of the present invention will become more apparent by describing in detail preferred exemplary embodiments thereof with reference to the accompanying drawings, wherein:

FIG. 10A is a side view of a mount screw in an antenna mounting structure according to a fourth embodiment of the invention;

FIG. 10B is a side view of a bush in the antenna mounting structure of FIG. 10A;

FIG. 11 is a side view of an engagement member and a mount screw in an antenna mounting structure according to a fifth embodiment of the invention;

DETAILED DESCRIPTION OF THE INVENTION

Preferred embodiments of the invention will be described below in detail with reference to the accompanying drawings.

According to a first embodiment of the invention, an antenna base 10 shown in FIGS. 2A to 2E is fixed within a housing 12. An amplifying circuit (not shown) is also accommodated in the housing 12. Moreover, the base end of an antenna element 16 is fixed to the housing 12.

Figure 1:
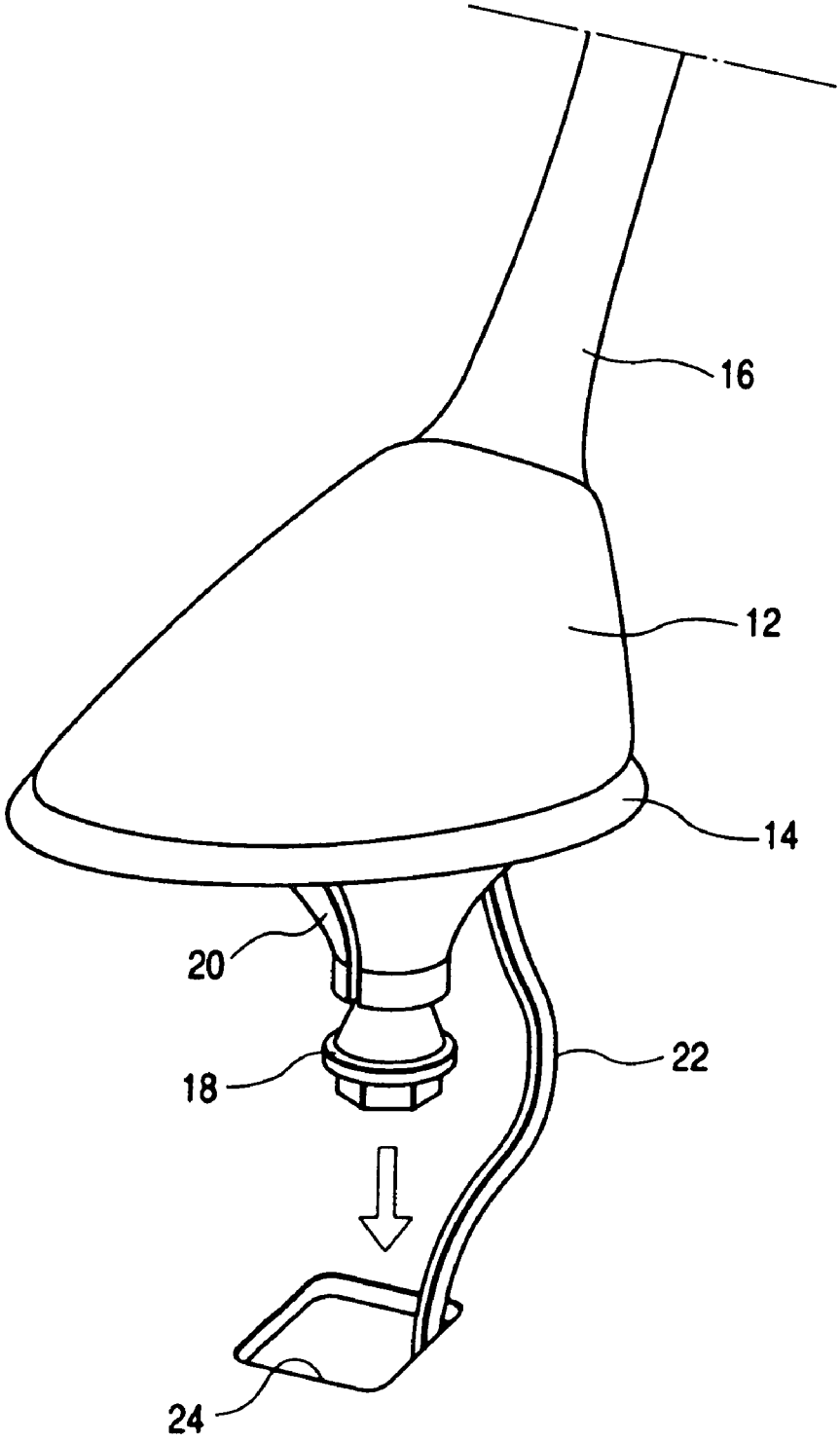
FIG. 1 is a perspective view showing an external appearance of an antenna device incorporating an antenna mounting structure according to a first embodiment of the invention.
Figure 2A:
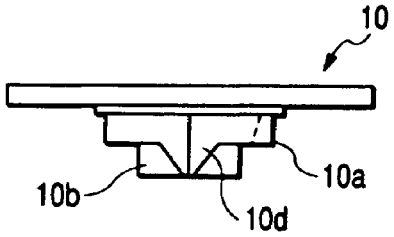
FIG. 2A is a front view of an antenna base in the antenna mounting structure of FIG. 1.
Figure 2B:
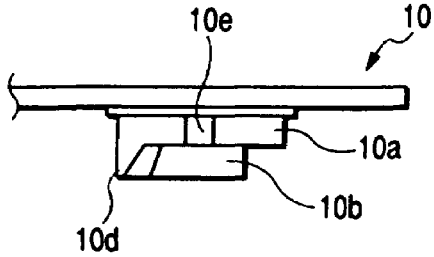
FIG. 2B is a side view of the antenna base of FIG. 2A.
Figure 2C:
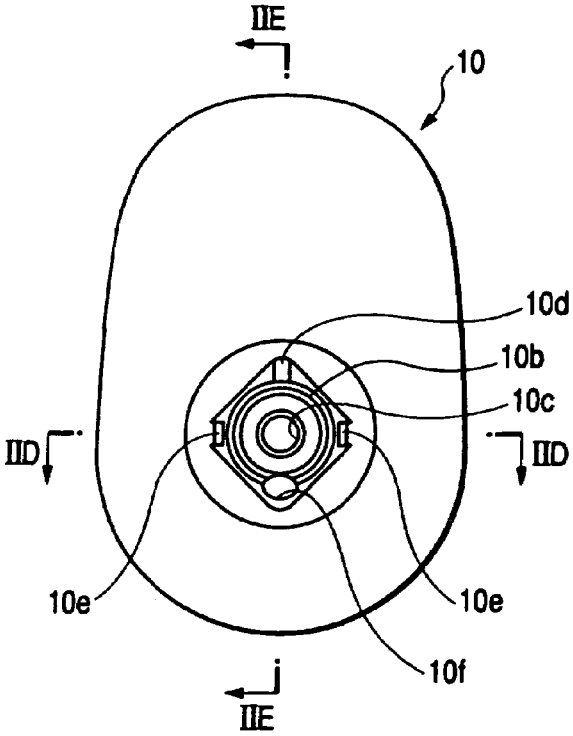
FIG. 2C is a bottom view of the antenna base of FIG. 2A.
Figure 2E:
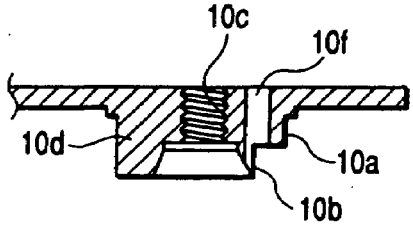
FIG. 2E is a section view taken along a line IIE—IIE in FIG. 2C.
Figure 2D:
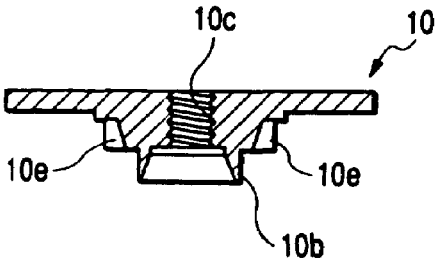
FIG. 2D is a section view taken along a line IID—IID in FIG. 2C.
Figure 3A:
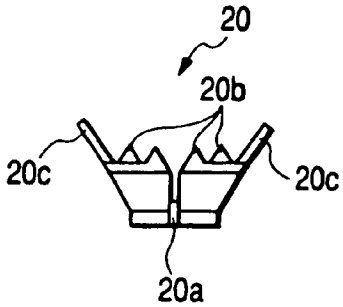
FIG. 3A is a front view of an engagement member in the antenna mounting structure of FIG. 1.
Figure 3B:
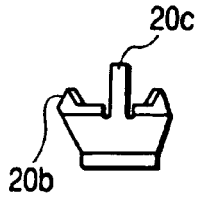
FIG. 3B is a side view of the engagement member of FIG. 3A.
Figure 3C:
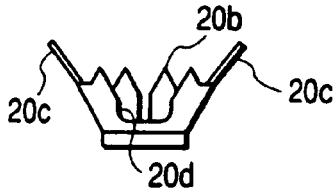
FIG. 3C is a rear view of the engagement member of FIG. 3A.
Figure 3D:
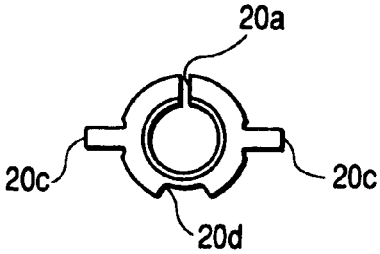
FIG. 3D is a bottom view of the engagement member of FIG. 3A.
Figure 3E:
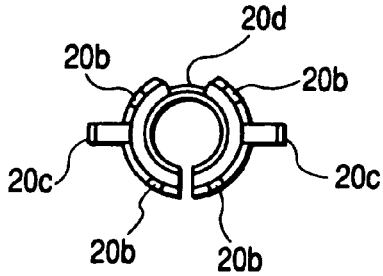
FIG. 3E is a top view of the engagement member of FIG. 3A.
Figure 4B:
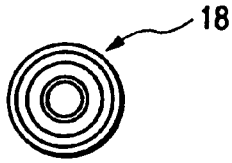
FIG. 4B is a top view of the mount screw of FIG. 4A.
Figure 4A:
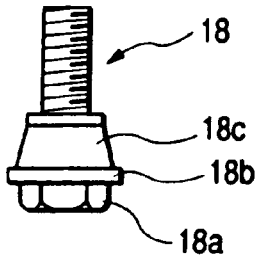
FIG. 4A is a side view of a mount screw in the antenna mounting structure of FIG. 1.
Figure 4C:
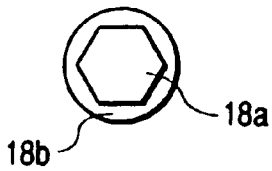
FIG. 4C is a bottom view of the mount screw of FIG. 4A.

The tip of a mount screw 18 shown in FIGS. 4A to 4C is screwed into the antenna base 10 from below as described later in detail. Moreover, an engagement member 20 shown in FIGS. 3A to 3E is fitted with the mount screw 18. Furthermore, a cable 22 such as a signal transmission line is led from the antenna base 10. With such a structure, as shown in FIG. 1, the cable 22 is first inserted from above into a mount hole 24 provided on a roof panel of a vehicle body, and furthermore, the mount screw 18 and the engagement member 20 are inserted therein to carry out a provisional fixation.

As shown in FIGS. 2A to 2E, the antenna base 10 is formed of a conductive material, and has a lower face provided with a square protrusion 10*a*. A cylindrical projection 10*b* is provided on the center of the square protrusion 10*a*. A female screw 10*c* is threaded in a vertical direction at the center of cylindrical projection 10*b*. A wedge-shaped member 10*d* in which the lower end thereof is narrowed is formed so as to connect one corner of the square protrusion 10*a* and the peripheral face of the cylindrical projection 10*b*. Notches 10*e* are formed at two corners of the square protrusion 10*a* which are adjacent to the corner at which the wedge-shaped member is provided. The notches 10*e* are for receiving provisional fixation claws 20*c* (described later in detail). A hole 10*f* penetrating the antenna base 10 in a vertical direction is formed in the vicinity of a corner of the square protrusion 10*a* which is opposite to the corner at which the wedge-shaped member is provided. The hole 10*f* is for allowing the cable 22 to pass therethrough.

As shown in FIGS. 3A to 3E, the engagement member 20 is formed by a conductive material plate and is shaped into a truncated cone in which a lower end diameter is less than an upper end diameter. The engagement member 20 is formed with a slit 20*a* so as to connect the upper end and the lower end thereof, so that the engagement member 20 is C-shaped in the plan view. At the upper end of the engagement member 20, there are formed four engagement claws 20*b* projecting upward and two provisional fixation claws 20*c* projecting obliquely upward and outward. The distal ends of the provisional fixation claws 20*c* are situated upper and outer than the distal ends of the engagement claws 20*b*. A cutout 20*d* is formed for receiving the cable 22.

As shown in FIGS. 4A to 4C, the mount screw 18 is formed of a conductive material. A screw body and a hexagonal head portion 18*a* are connected by a flange portion 18*b* and a truncated-conical portion 18*c*. The upper end of the truncated-conical portion 18*c* has an outer diameter which is slightly smaller than the inner diameter of the lower end of the engagement member 20 in an original state. The lower end of the truncated-conical portion 18*c* has an outer diameter which is larger than the inner diameter of the lower end of the engagement member 20 in an original state.

The antenna base 10 is fixed to the housing 12 in advance and the rubber packing member 14 is attached to the lower portion of the antenna base 10. The cable 22 is led from the inside of the housing 12 through the hole 10*f* of the antenna base 10. The mount screw 18 is fitted and inserted into the engagement member 20 and the tip portion of the mount screw 18 is screwed into the female screw 10*c* of the antenna base 10 so that the mount screw 18 and the engagement member 20 are integrated with the antenna base 10. The rubber packing member 14 is provided with a hole through which the square protrusion 10*a* of the antenna base 10 can penetrate.

Figure 5A:
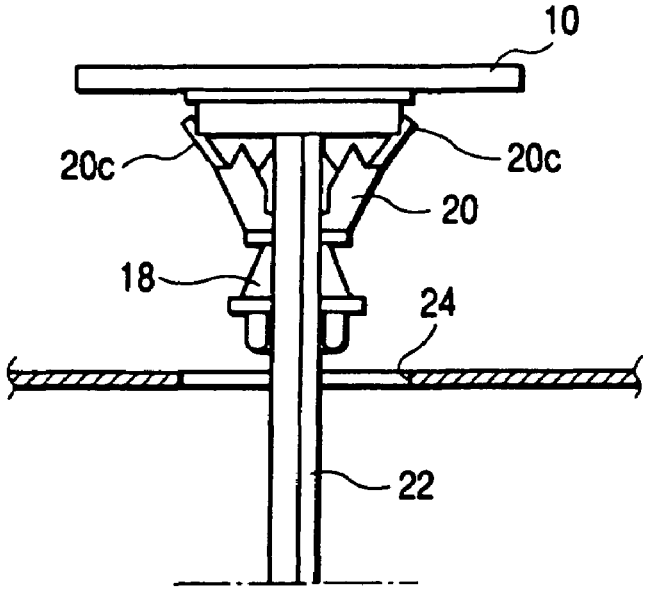
FIG. 5A is a side view showing a state before the antenna base of FIG. 2A is provisionally fixed on a roof panel of a vehicle.
Figure 5B:
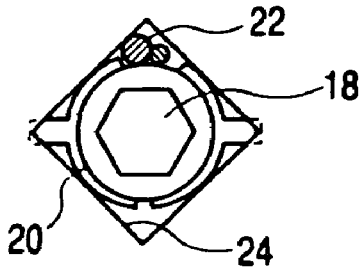
FIG. 5B is a bottom plan view showing the state of FIG. 5A.
Figure 6A:
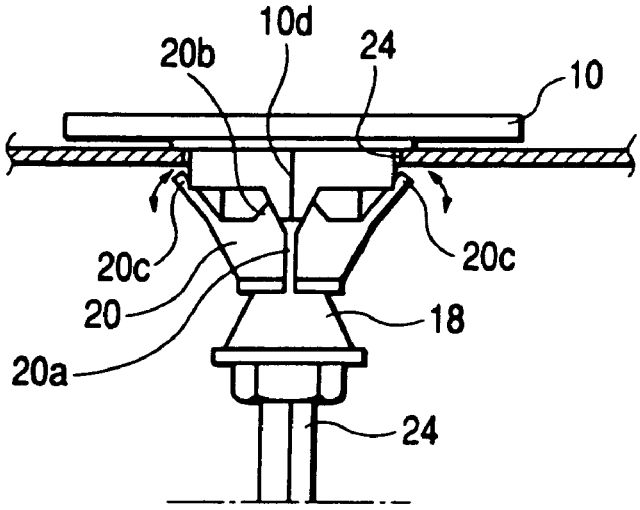
FIG. 6A is a side view showing a state that the antenna base of FIG. 2A is provisionally fixed on the roof panel.
Figure 6B:
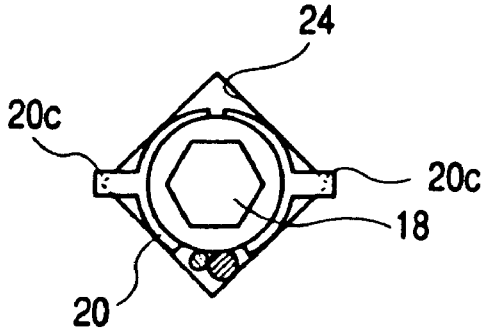
FIG. 6B is a bottom plan view showing the state of FIG. 6A.

In such an integrated state, as shown in FIGS. 1, 5A and 5B, the cable 22 is first inserted into the mount hole 24 provided on the roof panel to bring a condition in which the square protrusion 10*a* of the antenna base 10 faces the mount hole 24. The mount hole 24 takes an almost square shape which is slightly larger than the square protrusion 10*a*. When the cable 22 is inserted into the mount hole 24 from above in the state of FIG. 5, the provisional fixation claws 20*c* are elastically deformed on two opposed corners of the mount hole 24, thereby permitting the insertion. After a passage through the mount hole 24, the provisional fixation claws 20*c* are elastically returned and tips thereof are positioned in the peripheral edge portion of the mount hole 24 so that a state shown in FIGS. 6A and 6B is brought. Here, the antenna base 10 is provisionally fixed to the mount hole 24 of the roof by the provisional fixation claws 20*c*.

Figure 7A:
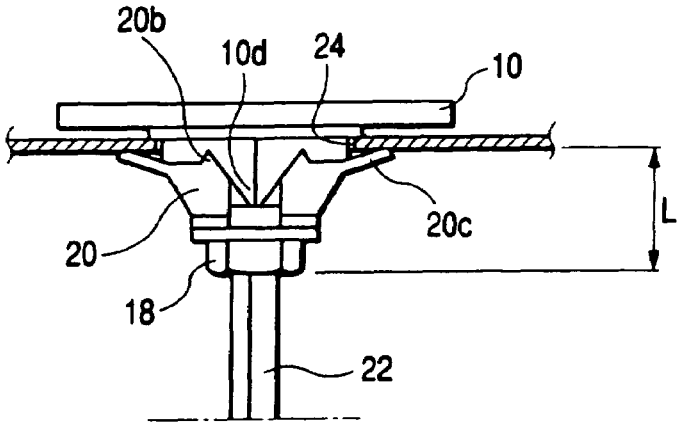
FIG. 7A is a side view showing a state that the antenna base of FIG. 2A is plenarily fixed on the roof panel.
Figure 7B:
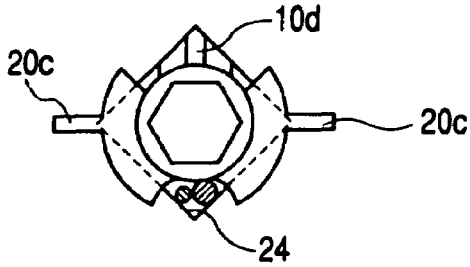
FIG. 7B is a bottom plan view showing the state of FIG. 7A.
Figure 7C:
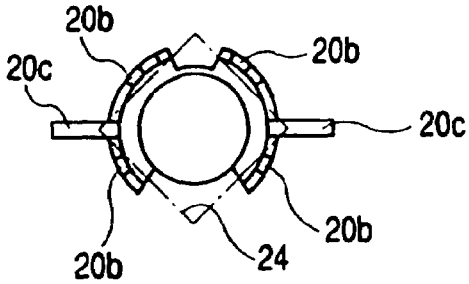
FIG. 7C is a schematic top plan view showing the state of FIG. 7A.

When the mount screw 18 is screwed into the female screw 10*c* of the antenna base 10, the tips of the provisional fixation claws 20*c* are first expanded over the back face of the roof panel. On the other hand, the wedge-shaped member 10*d* expands the slit 20*a* of the engagement member 20 from above by a wedge effect, and the truncated-conical portion 18*c* of the mount screw 18 also expands the slit 20*a* from below so that the diameter of the almost C shape of the engagement member 20 is more increased. As a result, as shown in FIGS. 7A to 7C, the engagement claws 20*b* of the engagement member 20 are positioned in the peripheral edge portion of the mount hole 24 and cut into the back face of the roof panel by the strong fastening of the mount screw 18. Accordingly, the antenna base 10 is plenarily fixed to the roof panel, while the electrical connection of the antenna base 10 and the roof panel is established by the engagement claws 20*b*.

With such a structure, a member obtained by integrating the engagement member 20 and the mount screw 18 with the antenna base 10 is simply inserted into the mount hole 24 from above the roof panel so that the antenna base 10 can be provisionally fixed to the roof panel. Thus, the provisional fixation work can easily be carried out. The mount screw 18 is rotated axially with the head portion 18*a* held by a tool from below the roof panel, and is thus screwed and fastened. Consequently, the engagement claws 20*b* of the engagement member 20 cut into the back face of the roof panel, and are thus fixed reliably and are electrically connected. In addition, since the mount hole 24 of the roof panel takes the almost square shape, the square protrusion 10*a* of the antenna base 10 is fixed to the roof in a constant posture.

Figure 8:
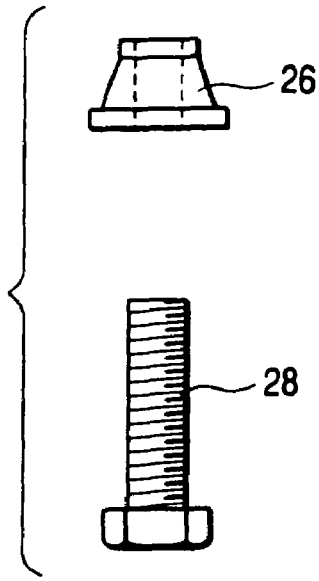
FIG. 8 is a side view of a mount screw in an antenna mounting structure according to a second embodiment of the invention.

FIG. 8 shows a second embodiment of the invention. In this embodiment, a mount screw is constituted by two members including a bush 26 taking the shape of a truncated cone and a screw 28 having a hexagonal head portion. The bush 26 has an upper outer diameter which is slightly smaller than the lower inner diameter of the engagement member 20, and a lower outer diameter set to be larger than the lower inner diameter of the engagement member 20 as in the first embodiment.

Figure 9A:
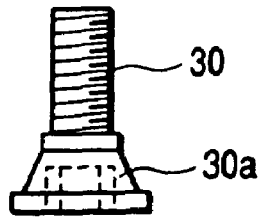
FIG. 9A is a side view of a mount screw in an antenna mounting structure according to a third embodiment of the invention.
Figure 9B:
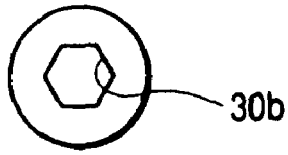
FIG. 9B is a bottom view of the mount screw of FIG. 9A.

FIGS. 9A and 9B show a third embodiment of the invention. In this embodiment, the hexagonal head portion in the first embodiment is omitted. Instead, a bottomed hole 30*b* having a hexagonal cross section is formed on a bottom face of a truncated-conical portion 30*a* of a mount screw 30. By inserting a hexagonal wrench into the bottomed hole 30*b*, it is possible to rotate the mount screw 30 to perform the screwing operation. When the screw 30 is screwed and fastened to fix the antenna base 10 to the roof, according to the omission of the head portion, a dimension L protruded from the back face of the roof panel shown in FIG. 7 can be reduced effectively.

FIGS. 10A and 10B show a fourth embodiment of the invention. In this embodiment, an engagement member 32 is provided with a slit 32*a* having a tapered portion 32*b* formed at the lower end portion thereof such that a clearance is enlarged toward the lower side. A bush 34 has an upper outer diameter which is slightly smaller than a lower inner diameter of the engagement member 32 and a lower outer diameter which is set to be larger than the lower inner diameter of the engagement member 32. Moreover, a flange portion 34*a* is provided on the lower end of the bush 34, and a wedge-shaped member 34*b* to be inserted into the tapered portion 32*b* of the engagement member 32 to expand the clearance of the slit 32*a* is formed on an outer peripheral face of the bush 34. Furthermore, there is provided a mount screw 36 for penetrating through the engagement member 32 and the bush 34 in a vertical direction. In this embodiment, the engagement member 32 can expand the clearance of the slit 32*a* by the wedge effect of the wedge-shaped member 34*b* of the bush 34.

FIG. 11 shows a fifth embodiment of the invention. In this embodiment, an engagement member 38 is provided with a truncated cone-shaped portion 38*a* in which an inner diameter is increased downward. An mount screw 40 is provided with a cylindrical member 40*a* having a slightly smaller outer diameter than the lower inner diameter of the truncated cone-shaped portion 38*a*. In this embodiment, the cylindrical member 40*a* abuts on an inner face of the truncated cone-shaped portion 38*a* by screwing and fastening the mount screw 40, thereby expanding the engagement member 38.

Next, a sixth embodiment of the invention will be described with reference to FIGS. 12A through 15B.

Figure 12A:
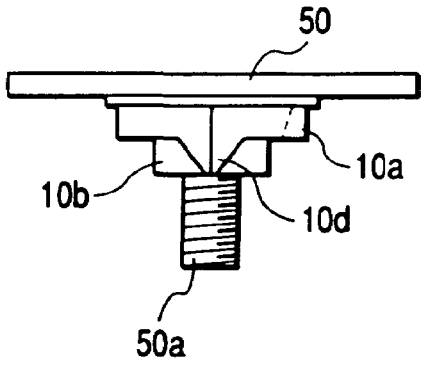
FIG. 12A is a front view of an antenna base in an antenna mounting structure according to a sixth embodiment of the invention.
Figure 12B:
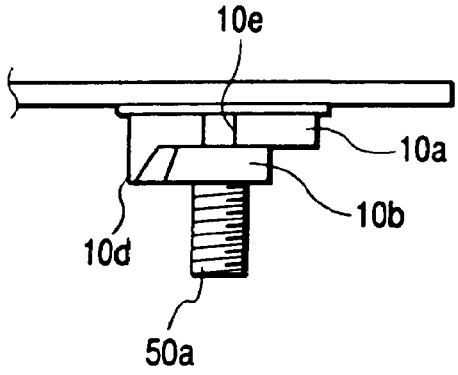
FIG. 12B is a side view of the antenna base of FIG. 12A.
Figure 13A:
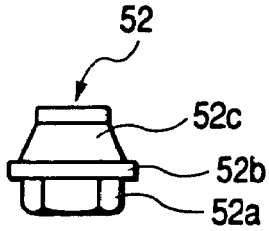
FIG. 13A is a side view of a nut fitted with the antenna base of FIG. 12A.
Figure 13B:
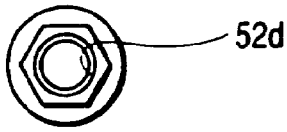
FIG. 13B is a bottom view of the nut of FIG. 13A.

As shown in FIGS. 12A and 12B, an antenna base 50 in this embodiment is different from the antenna base 10 in the first embodiment in that a mount screw 50*a* is protruded downward from the antenna base 50 in place of the threading of the female screw 10*c*. A nut 52 shown in FIGS. 13A and 13B is constituted by a hexagonal head portion 52*a*, a flange portion 52*b* and a truncated-conical portion 52*c*, and a female screw 52*d* capable of being screwed into the mount screw 50*a* is threaded on a center of truncated-conical portion 52*c*. The truncated-conical portion 52*c* of the nut 52 has an upper outer diameter which is set to be smaller than a lower inner diameter of an engagement member 20 and a lower outer diameter which is set to be larger than the lower inner diameter of the engagement member 20. In this embodiment, the same engagement member 20 as that in the first embodiment is used.

Figure 14:
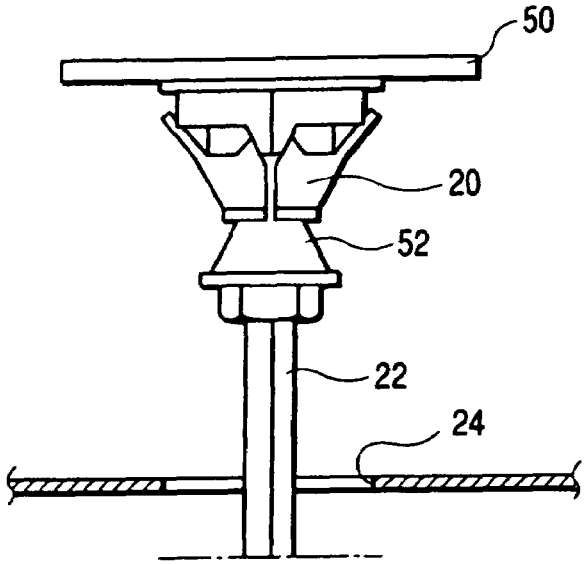
FIG. 14 is a side view showing a state before the antenna base of FIG. 12A is provisionally fixed on a roof panel of a vehicle.
Figure 15A:
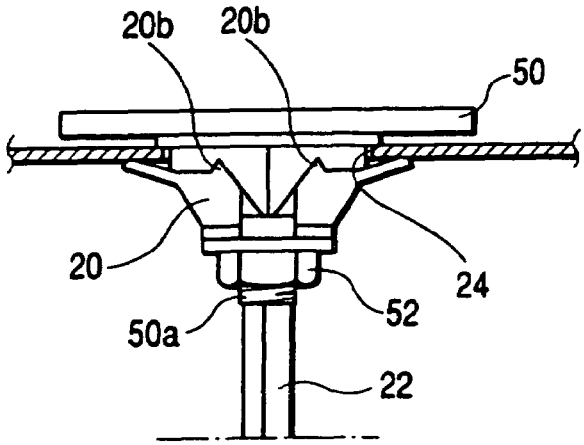
FIG. 15A is a side view showing a state that the antenna base of FIG. 12A is plenarily fixed on the roof panel.
Figure 15B:
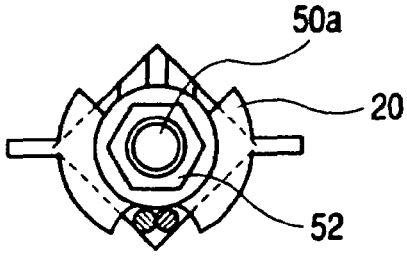
FIG. 15B is a bottom plan view showing the state of FIG. 15A.

The engagement member 20 and the nut 52 are assembled into the antenna base 50 and they are integrated with each other, and a cable 22 is inserted through a mount hole 24 of a roof panel from above as shown in FIG. 14 and they are strongly pressed downward in this state. Consequently, provisional fixation claws 20*c* of the engagement member 20 are elastically deformed and are thus permitted to be inserted, and are elastically returned after a passage through the mount hole 24 so that an upward slip-off from the mount hole 24 can be prevented to establish a provisional fixation state. When the nut 52 protruded downward is strongly fastened, the diameter of the engagement member 20 is greatly changed so that engagement claws 20*b* cut into the peripheral edge portion of the mount hole 24 on the back side of the roof panel as shown in FIG. 15. The engagement member 20 is thus fixed on the roof panel while establishing electrical connection therebetween.

Also in this embodiment, various mechanisms for expanding the slit of the engagement member 20 as explained in the fourth and fifth embodiments may be properly adopted. Further, variations as explained in the second and third embodiments may be adopted. That is, the head portion 52*a* of the nut 52 may be omitted and a hexagonal bottomed hole may be provided. Further, the head portion 52*a* and the truncated-conical portion 52*c* in the nut 52 may be provided as separate members.

In the above embodiments, two provisional fixation claws 20*c* are provided. However, the number of the provisional fixation claws 20*c* may be more than two. In the above embodiments, the mount hole 24 formed on the roof panel is shaped into square. However, the shape of the mount hole 24 may be circular or oval. In this case, the shape of the protrusion 10*a* of the antenna base 10 is properly changed so as to correspond to the shape of the mount hole 24. In the above embodiments, the engagement claws 20*b* are cut into the back face of the roof panel to establish the electric connection therebetween. However, if it is not necessary to establish the electric connection, or any other member for establish the electric connection is provided, the engagement member 20 may not be a conductive member. In this case, the engagement member 20 may be made of any materials capable of being deformed elastically or plastically.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A structure for mounting an antenna device on a first side of a panel body, the structure comprising:

a first fixation member, comprising:

a tubular body, including a first end having a first width, a second end, and a slit connecting the first end and the second end; and a plurality of elastic claw members, including a pair of claw members extended from the first end of the tubular body such that an interval between distal ends thereof is a second width which is larger than a third width of an aperture formed in the panel body;

a protrusion, protruded from the antenna device and fitted into the first end of the first fixation member;

a second fixation member, fitted into the second end of the first fixation member while being coupled with the protrusion in a screwing manner, wherein:

the first width is smaller than the third width when the protrusion and the second fixation member are in a first screwing position, so that the protrusion, the first fixation member and the second fixation member are allowed to pass through the aperture from the first side to a second side while flexing the pair of claw members inward;

the pair of claw members restore so as to prevent the protrusion, the first fixation member and the second fixation member from passing through the aperture from the second side to the first side; and the slit is expanded such that the first end of the first fixation member is made to have a fourth width which is greater than the third width when the protrusion and the second fixation member are in a second screwing position where the protrusion and the second fixation member are closer to each other than the first screwing position.

2. The structure as set forth in claim 1, further comprising a wedge member, formed on at least one of the protrusion and the second fixation member, the wedge member fitted into the slit when the protrusion and the second fixation member are in the first screwing position, wherein the wedge member is configured so as to expand the slit when the protrusion and the second fixation member are in the second screwing position.

3. The structure as set forth in claim 1, wherein the first end of the second fixation member has a first diameter and the second end of the second fixation member has a second diameter which is larger than the first diameter.

4. The structure as set forth in claim 1, wherein the aperture and the protrusion are rectangularly shaped.

* * * * *